US009339132B2

(12) United States Patent
Burrell et al.

(10) Patent No.: US 9,339,132 B2
(45) Date of Patent: May 17, 2016

(54) ADJUSTABLE POSTURAL ALIGNMENT MEDITATIVE FLOOR MAT

(71) Applicants: Jamison Burrell, Santa Monica, CA (US); Rachel Burrell, Santa Monica, CA (US)

(72) Inventors: Jamison Burrell, Santa Monica, CA (US); Rachel Burrell, Santa Monica, CA (US)

( * ) Notice: Subject to any disclaimer, the term of this patent is extended or adjusted under 35 U.S.C. 154(b) by 0 days.

(21) Appl. No.: 14/731,741

(22) Filed: Jun. 5, 2015

(65) Prior Publication Data

US 2015/0360075 A1 Dec. 17, 2015

Related U.S. Application Data

(60) Provisional application No. 62/011,035, filed on Jun. 12, 2014.

(51) Int. Cl.
*A47G 9/06* (2006.01)

(52) U.S. Cl.
CPC *A47G 9/062* (2013.01); *A47G 9/06* (2013.01); *A63B 2210/50* (2013.01)

(58) Field of Classification Search
CPC ..... A63B 2210/50; A63B 21/1473; A47D 15/003; A47G 9/06; A47G 9/062
USPC ..... D6/582
See application file for complete search history.

(56) References Cited

U.S. PATENT DOCUMENTS

D554,423 S * 11/2007 Huffman ..... D6/582
2007/0226904 A1* 10/2007 Huffman ..... A63B 23/12 5/417
2007/0275827 A1* 11/2007 Glaser ..... A63B 21/1473 482/23
2008/0118671 A1* 5/2008 Bienkiewicz ..... A47C 27/001 428/12
2012/0233772 A1* 9/2012 Wang ..... A47G 24/0237 5/417

* cited by examiner

*Primary Examiner* — David E Sosnowski
*Assistant Examiner* — Amanda L Miller

(57) ABSTRACT

An adjustable, portable floor mat that varies in height, shape, firmness, length and thickness according to the users specific needs. The first end of the mat will be the unadjustable, uninterrupted, rollable portion of the mat, with the second end including a number of embossed or sewn linear indentations to make the proper seating adjustments. The material will be substantial and supportive but foldable along the linear indentations allowing for an adjustable second end of the mat. The linear indentations fold horizontally into panels acting as a booster seat elevating the user to various height levels. The first end provides comfort and an appropriate amount of padding for the knees and ankles. The second end places the user into proper postural alignment providing an optimum setup for a neutral spine in all seated meditative positions and/or prescribed exercise regiments.

3 Claims, 4 Drawing Sheets

10
10
8
8
9
9
6
6
3
3
5
5
2
2
1
1
7
7
4

2
9
5
6
3
7
8
10
4

2
6
9
1
7
8
4
10

10
10
1
2
3
4
5
6
7
8
9

ADJUSTABLE POSTURAL ALIGNMENT MEDITATIVE FLOOR MAT

FIELD OF INVENTION

This invention relates to exercise equipment pertaining to stretching, yoga, meditation and postural alignment. More specifically, the invention relates to a new mat that adjusts in height, width, thickness, shapes and sizes while being encapsulated by one unit of material providing a resilient, long lasting, rugged construct aiding in physical and mental health.

BACKGROUND OF THE INVENTION

Meditation has been practiced since antiquity as a component of numerous religious traditions and beliefs. While meditation is often thought of for its transformation of the mind, research today is proving meditation is also an effective therapeutic physical intervention counteracting the adverse clinical effects of stress in disorders including hypertension, anxiety, insomnia and aging. With approximately 20 million Americans practicing, meditation is now one of the top three alternative health methods today in the United States.

Cross-legged mediation, a seated posture method with one leg placed over the other (lotus/half lotus) is adopted to allow the body to be held completely steady for long periods of time. Assuming the correct posture is an indispensable part of sitting meditation. Without proper postural alignment, weakness or misalignment in the pelvic structure may occur which can cause short-term pain or more long-term structural damage including back and/or leg pain. The lotus/half lotus asana applies pressure to the lower spine allowing relaxation to take place. The breath slows down, muscular tension decreases and blood pressure subsides. The coccygeal and sacral nerves are toned as the normally large blood flow to the legs is redirected to the abdominal region, which may help to improve digestion.

For most people, seating in the cross-legged position may not be easy; it can cause pain because the joints have already been stiffened. Also, when sitting for a long time the buttocks are overstrained, which can easily lead to physical pain. A mat is necessary to prevent pain during sitting meditation. However, there is much more that is needed than just "any old mat" to have a successful and meaningful meditation. When doing sitting meditation on the floor, to relieve the weight of the legs, one needs to fold the sit on the folded part of a long mat, sit on a pillow and/or blanket or two, or add another mat in order to sit on the raised portion. An excessively thick or thin mat is not desirable. If it is too thick, the buttocks may feel cozy but the legs can become uncomfortable. If too thin, the legs are comfortable but the buttocks may feel too much weight, preventing one from enduring for a long time.

In order to assist with this, the present invention is an adjustable postural alignment meditation floor mat, adjusting the seat for flexibility in the joints and comfort throughout the duration of the practice/usage. The mat is uniquely designed to encapsulate all the personal needs a user may have within this one device, unlike any other current option for yoga and meditation practices. One half (the second end) of the mat includes horizontal linear indentations creating panels for the user to be seated upon. The material on this side of the mat will be as thick or thicker than the other half or first end, creating inherently different height levels allowing the user to adjust for their own individual unique circumstances, needs and usages by simply folding across the linear indentations to different levels. As referenced, the other half or first end of the mat provides an appropriate amount of cushion for optimal comfort for the legs, knees and ankles. The mat having an adjustable height aspect provides a function of improving flexibility in postural neutral spinal alignment and tightness in joints for users of all abilities. The invention is simple, portable, foldable and may be able to roll up into a yoga bag.

SUMMARY OF THE INVENTION

The present invention is an adjustable, portable floor mat that varies in height, shape, firmness, length and thickness according to the users specific needs. The first end of the mat will be the unadjustable, uninterrupted, rollable portion of the mat, with the second end including a number of linear indentations to make the proper seating adjustments. The material will be substantial and supportive but foldable along the embossed/sewn linear indentations allowing for an adjustable second end of the mat. The linear indentations fold horizontally into panels acting as a booster seat elevating the user to various height levels. The first end provides comfort and an appropriate amount of padding for the knees and ankles. The second end places the user into proper postural alignment providing an optimum setup for a neutral spine in all seated meditative positions/prescribed exercise regiments.

Alternatively, the postural alignment meditative floor mat allows the user to explore areas physically that need attention and releasing on a more medical basis. The present invention allows each user to adjust the floor mat to their personal level of medical necessity creating a more ideal opportunity for good postural alignment in turn, reducing the "bad posture" ailments including misalignment of the spine with any/all of its adjoining structures, joint stress, growth issues, digestive issues, osteoarthritis, etc.

DETAILED DESCRIPTION OF THE INVENTION AND DRAWINGS

Description of the invention will now be given with reference to FIGS. 1-5A. It should be understood that these figures are exemplary in nature and in no way serve to limit the scope of the invention, which is defined by the claims appearing hereinbelow.

Figures 1, 2:
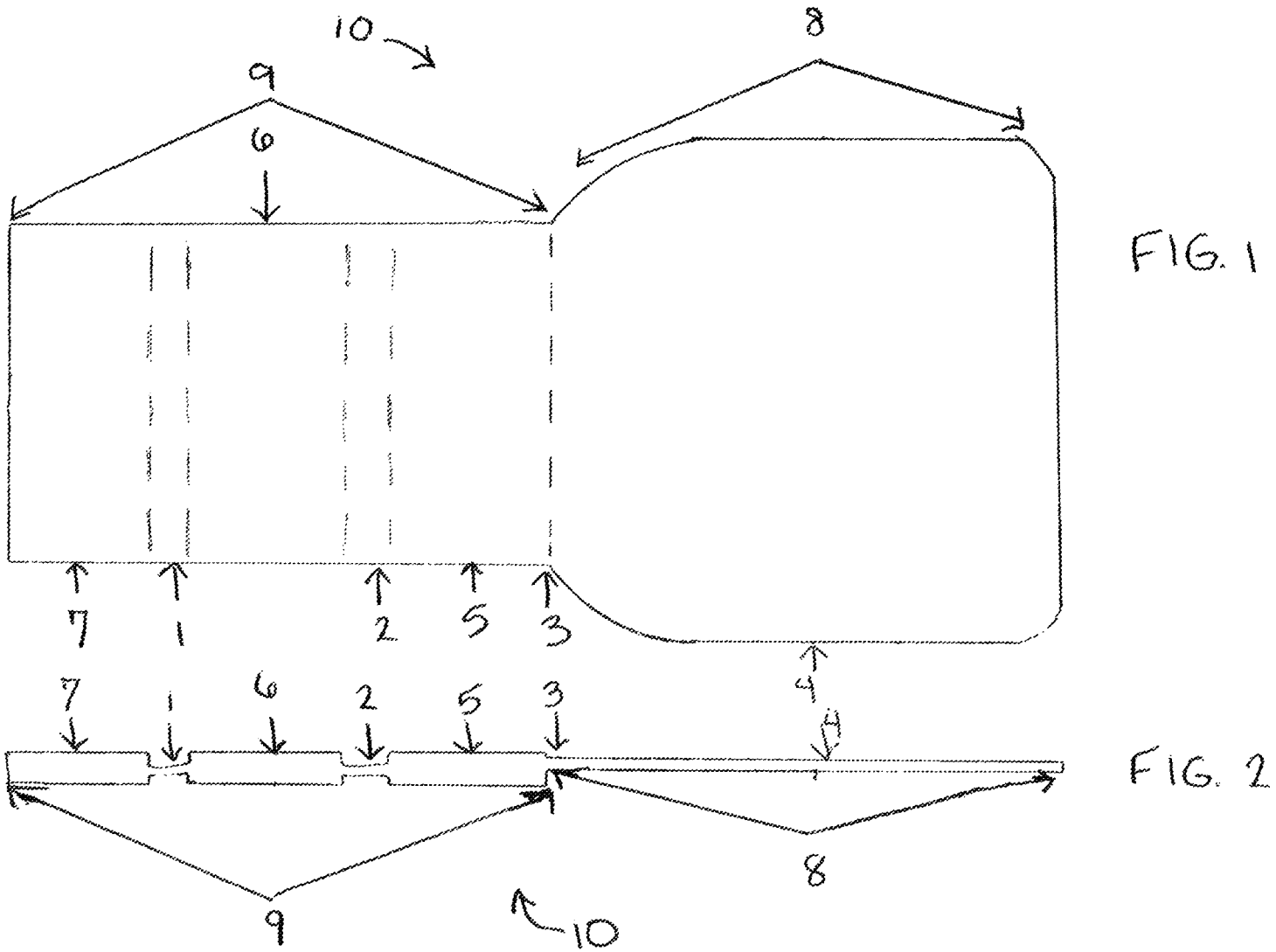
FIG. 1 is a top plan view of the meditative mat in it's unrolled position in accordance with the invention.
FIG. 2 is a side elevation view of the meditative mat unrolled of FIG. 1 in accordance with the invention.

An exemplary embodiment of a postural alignment meditative mat 10 is illustrated in FIGS. 1-2 in its unrolled state. The postural alignment meditative mat 10 is comprised of a first end 8 and a second end 9. The first end 8 is a soft, flat, uninterrupted pad of material 4. The second end 9 is comprised of a plurality of horizontal linear indentations numbered 1-3 respectively for this example. As shown in FIG. 1, a horizontal linear indentation 3 must be placed at the junction of where the first end 8 and second end 9 meet as this horizontal linear indentation determines where the first end 8 ends and second end 9 begins. The linear indentations 1-3 are embossed or sewn on both sides of the meditative mat 10 using embossing or sewing techniques according to the needs of the material. Staying consistent with the previous example of three horizontal linear indentations, three paneled sitting cushions 5-7 or as many as desired are then created as a result of the horizontal linear indentations 1-3 on the second end 9 of the adjustable meditative mat 10.

Figure 3:
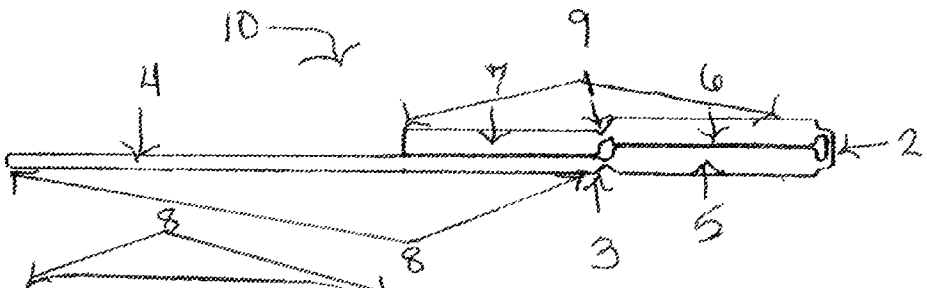
FIG. 3 is a side elevation view of the meditative mat of FIGS. 1-2 in accordance with the invention, folded into its first adjusted level.
Figure 3A:
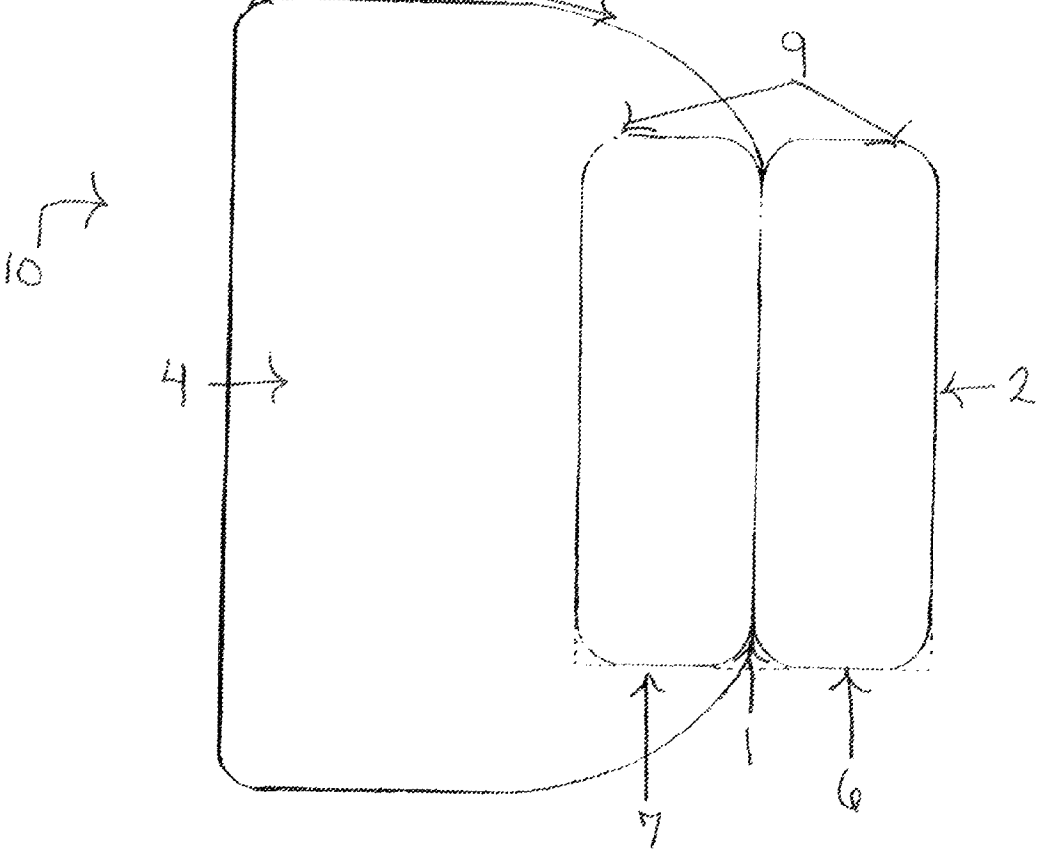
FIG. 3A is a top plan view of the meditative mat of FIGS. 1-3 in accordance with the invention, folded into its first adjusted level.
Figures 4, 4A:
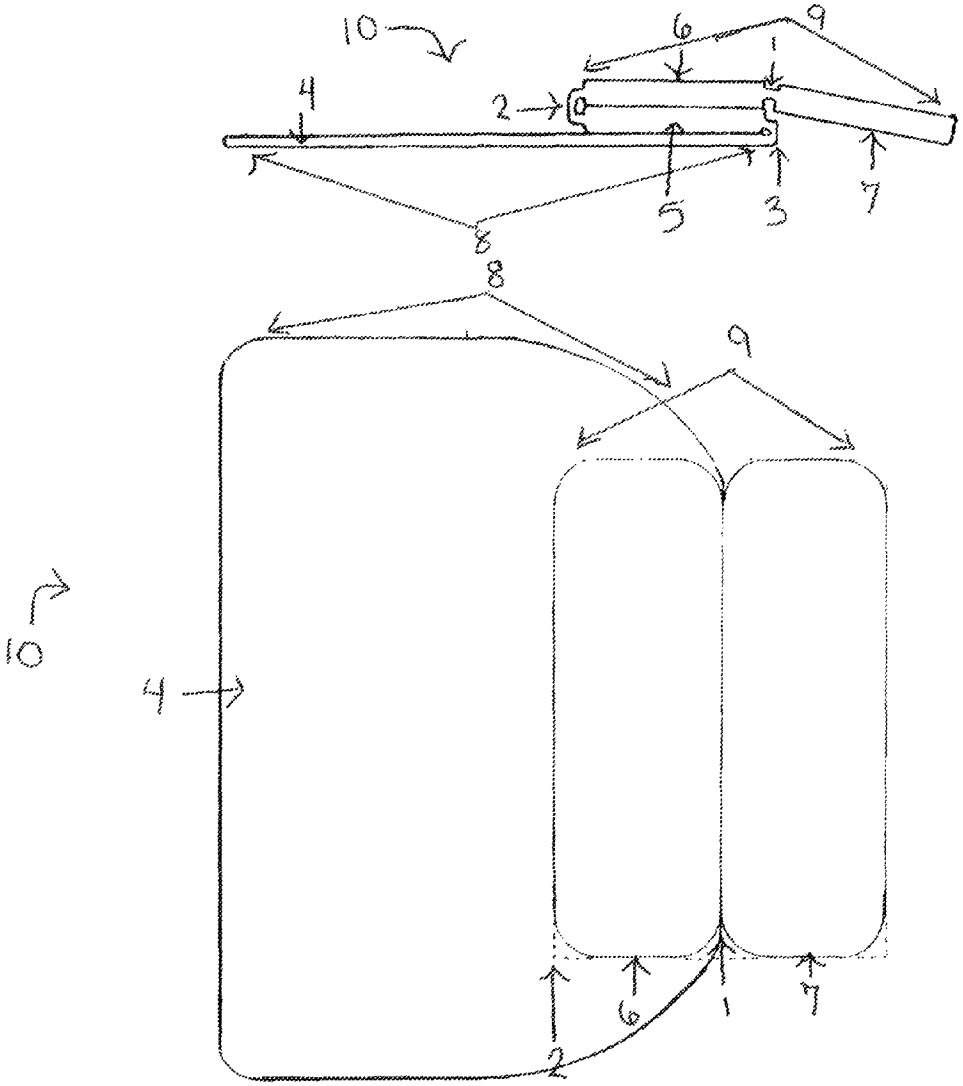
FIG. 4 is a side elevation view of the meditative mat of FIGS. 1-3A in accordance with the invention, folded into its second adjusted level.
FIG. 4A is a top plan view of the meditative mat of FIGS. 1-4 in accordance with the invention, folded into its second adjusted level.
Figure 5:
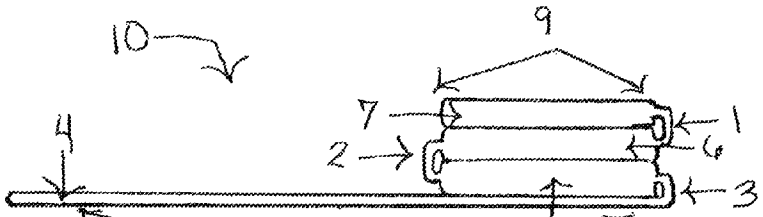
FIG. 5 is a side elevation view of the meditative mat of FIGS. 1-4A in accordance with the invention, folded into its third adjusted level.
Figure 5A:
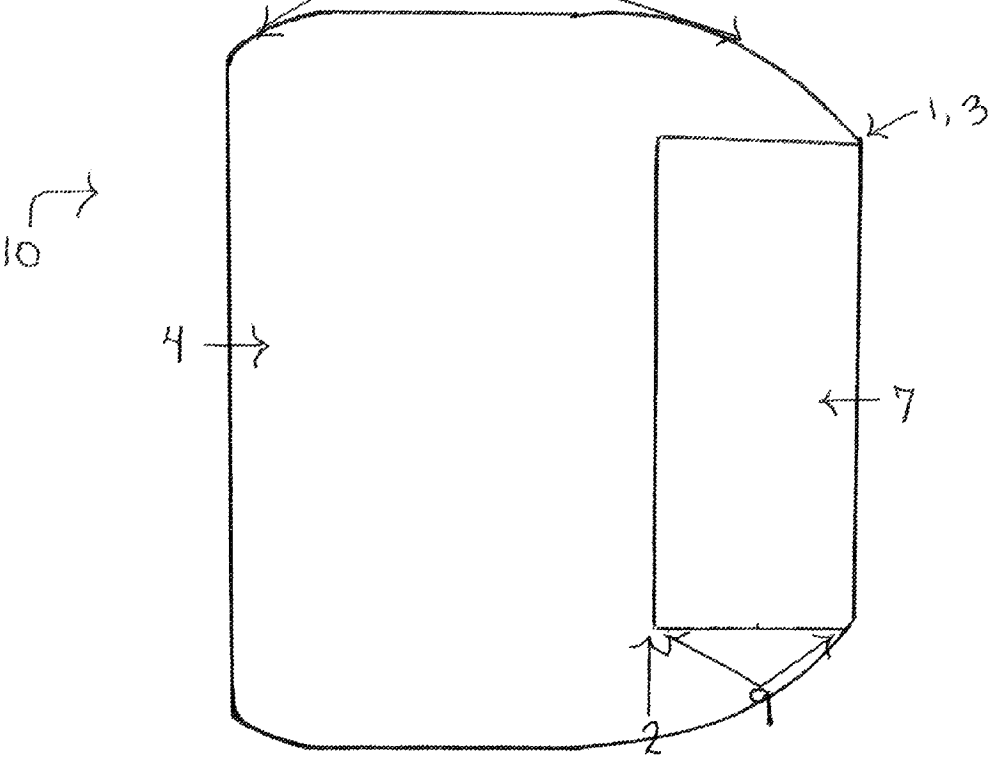
FIG. 5A is a top plan view of the meditative mat of FIGS. 1-4A in accordance with the invention, folded into its third adjusted level.

FIGS. 3-5A show that the adjustable postural alignment meditative floor mat 10 shown in FIGS. 1-2 being transformed into adjustable levels to cater to individual physical restraints for all users to achieve neutral anatomical position and proper postural realignment by folding the meditative mat 10 along some or all of the horizontal linear indentations 1-3. As shown in FIG. 3 and FIG. 3A, the mat can be folded using one linear indentation 2 and leaving linear indentations 1, 3 unused (level 1). FIG. 4 and FIG. 4A illustrates the transformed mat after folding linear indentations 1 and 2 leaving linear indentation 3 unused (level 2). FIG. 5 and FIG. 5A illustrates the transformed mat after folding linear indentations 1, 2 and 3 in its maximum adjustable state for illustrative purposes.

The second end 9 of the meditative mat 10 is intended for the user to sit their seat on allowing their legs and ankles to be comfortably supported beneath the user on the mat 4 of the first end 8. As shown in FIGS. 3A, 4A and 5A the users seat will be seated on one of the paneled sitting cushions 5-7 depending on the level or position of the current invention. The mat 10 on the first end 8 will provide comfort and an appropriate amount of padding for the knees and ankles while the second end 9 will provide comfort with an optimum setup for all users to achieve a neutral spine with any/all of its adjoining structures while aFlso reducing physical pain including joint stress and osteoarthritis.

The meditative mat 10 is manufactured so the first end 8 may be be a varying thickness and possibly firmness from the second end 9 when necessary. The meditative mat 10 on the first end 8 can have a thickness of at least about 3 mm (⅛") and/or at most about 2 inches in a completely unfolded state. The meditative mat 10 on the second end 9 is manufactured to be at least as thick or thicker than the first end 4, 8 in order to aid in proper postural alignment for all levels and circumstances. For example, if the first end 8 of the mat is ⅜", the second end 9 of the mat could also be ⅜" or it could be ⅝" or ¾" when in its unfolded position. It is suggested that the first end 8 not be any thinner than 3 mm as anything thinner than that may not provide a comfortable support for practice. The second end 9 must be as thick or thicker than the first end 4, 8 to benefit from this invention. The linear indentations 1-3 are both on the top and bottom of the mat 10 material. The dimensions of linear indentations are to ensure easy folding and unfolding of the material, and they could vary based on various factors such as thickness of the mat and the material of the mat. FIG. 5 illustrates one exemplary embodiment of the invention.

Yoga mats are generally rectangular but may come in other shapes and sizes. The present invention is uniquely shaped to adjust for the contours of the users structure making the shape similar to that of a skeleton key as shown in FIG. 1 with a wider first end 8 than the second end 9. The meditative mat 10 can be made from any suitable materials. In some embodiments, the mat is made from one or more of the following materials: foam, felt, wood, cork, PVC, TPE, rubber, rubber-like material, ethylene vinyl acetate, polymer enironmental-friendly resin, cotton, microfiber, polyester, wool, or any other appropriate material. If a mat material is used initially, the linear indentations are embossed on the same piece of material of the mat, which would preserve the desired qualities of the mat such as the patterns, the non-slip surface and the integrated feeling of the mat.

In some embodiments, the entire meditative mat 10 construct is encapsulated with felt, hemp, polyester, nylon or a resilient fabric to further strengthen the mat 10 and to prevent ripping or damage of the materials on the surfaces or at the the linear indentations 1-3. The linear indentations 1-3 may be embossed and or sewn on the top and bottom of the mat 9, allowing the invention to fold both forwards and backwards. For example, If a mat is made with wood and cork on the second end 9 for a more stable seated posture instead of a typical yoga/exercise mat material, as opposed to the heat embossing techniques, the chosen encapsulation material would be sewn together at the linear indentation 1-3 junctions to still allow for a flexible, long lasting, foldable, stackable second end 9 of the invention. A typical unfolded yoga mat has a thickness of 3 mm (about ⅛ inch) to 12 mm (about ½ inch), with any mat thinner than 3 mm too thin to provide comfortable support for practice. The meditative mat 10 can have widths ranging between 16 and 47 inches and lengths ranging from 48 to 98 inches.

It will be apparent to those skilled in the art that various modifications and variations can be made to the adjustable postural alignment meditative floor mat without departing from the scope of the present invention. This invention is capable of being carried out in various sizes and ways and will be apparent to those skilled in the art from consideration of the specification and practice of the invention disclosed herein. As previously noted, the figures and descriptions shown here are for illustrative purposes only and should not be regarded as limiting.

The invention claimed is:

1. A floor mat, comprising:

a first end portion and a second end portion integral with the first end portion, and the first end portion and the second end portion having substantially equal lengths when the floor mat is in a completely unfolded position;

the first end portion having a uniform thickness of approximately ⅜ of an inch and having a generally rectangular shape comprising a first generally planar transverse end and first and second longitudinal ends extending in a direction perpendicular to the transverse end, wherein the first and second longitudinal ends connect to the transverse end at first and second rounded corners respectively, the first and second rounded corners having substantially equal radiuses of curvature, the first and second longitudinal ends being connected to the second end portion at third and fourth rounded corners positioned on ends of the first and second longitudinal ends opposite the first and second rounded corners respectively, the third and fourth rounded corners having substantially equal radiuses of curvature, wherein the radiuses of curvature of each of the third and fourth rounded corners is greater than the radiuses of curvature of each of the first and second rounded corners;

the second end portion having a generally rectangular shape comprising a second generally planar transverse end having a width less than a width of the first transverse end, the second end portion comprising a plurality of horizontal linear indentations formed on a top surface and a bottom surface of the second end portion and extending in a direction parallel to the first and second generally planar transverse ends when the floor mat is in the completely unfolded position , the plurality of linear indentations separating the second end portion into a plurality of substantially equal paneled sitting cushions each having a generally rectangular shape, each of the plurality of paneled sitting cushions having a thickness of approximately ¾ of an inch and each horizontal linear indentation having a depth less than the thickness of the sitting cushions;

the floor mat is configured to transition between the completely unfolded position and a folded position in which at least one of the plurality of paneled sitting cushions is folded about one of the linear indentations so as to be located above and in direct contact with another of the plurality of paneled sitting cushions or the first end portion;

and wherein the floor mat comprises one or more materials selected from the group consisting of: foam, felt, wood, cork, PVC, TPE, rubber, ethylene vinyl acetate, polymer environmental-friendly resin, hemp, cotton, microfiber, polyester, or wool.

2. The mat of claim 1, wherein the first end portion and the second end portion comprise different materials.

3. The mat of claim 1, wherein the mat is capable of being transitioned into one or more of a folded form, a rolled form, or a stored form, and when in one of said forms the mat is capable of being inserted into a customized bag, carrier, or straps so as to be carried.

* * * * *